US011009318B2

(12) United States Patent
Roland et al.

(10) Patent No.: US 11,009,318 B2
(45) **Date of Patent: *May 18, 2021**

(54) POLYMER COATINGS WITH EMBEDDED HOLLOW SPHERES FOR ARMOR FOR BLAST AND BALLISTIC MITIGATION

(71) Applicant: The Government of the United States, as represented by the Secretary of the Navy, Washington, DC (US)

(72) Inventors: Charles M. Roland, Waldorf, MD (US); Daniel Fragiadakis, Alexandria, VA (US); Raymond Gamache, Indian Head, MD (US); Carl Giller, Alexandria, VA (US); Roshdy Barsoum, McLean, VA (US)

(73) Assignee: The Government of the United States of America, as represented by the Secretary of the Navy, Washington, DC (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/231,158

(22) Filed: Dec. 21, 2018

(65) Prior Publication Data

US 2019/0120599 A1 Apr. 25, 2019

Related U.S. Application Data

(63) Continuation of application No. 14/751,596, filed on Jun. 26, 2015, now Pat. No. 10,161,721.

(60) Provisional application No. 62/017,685, filed on Jun. 26, 2014.

(51) Int. Cl.

| | |
|---|---|
| ***F41H 5/04*** | (2006.01) |
| *F41H 1/08* | (2006.01) |
| *F41H 1/04* | (2006.01) |

(52) U.S. Cl.

CPC ..... *F41H 5/0492* (2013.01); *F41H 5/0428* (2013.01); *F41H 5/0457* (2013.01); *F41H 5/0478* (2013.01); *F41H 1/04* (2013.01); *F41H 1/08* (2013.01)

(58) Field of Classification Search

USPC ..... 89/36.05

See application file for complete search history.

(56) References Cited

U.S. PATENT DOCUMENTS 10,161,721 B2 * 12/2018 Roland ..... F41H 5/0492

* cited by examiner

*Primary Examiner* — Reginald S Tillman, Jr.

(74) *Attorney, Agent, or Firm* — US Naval Research Laboratory; Sean M. Walsh

(57) ABSTRACT

A lightweight armor system providing blast protection and ballistic protection against small arms fire, suitable for use in helmets, personnel or vehicle protection, and other armor systems. A hard substrate is coated on the front surface with a thin elastomeric polymer layer, in which hollow ceramic or metal spheres are encapsulated. The coating layer having a thin elastomeric polymer layer with encapsulated metal or ceramic hollow spheres can be stand-alone blast protection, or can be added to an underlying structure. The glass transition temperature of the polymer is preferably between negative fifty Celsius and zero Celsius.

22 Claims, 4 Drawing Sheets

POLYMER COATINGS WITH EMBEDDED HOLLOW SPHERES FOR ARMOR FOR BLAST AND BALLISTIC MITIGATION

CROSS-REFERENCE TO RELATED APPLICATIONS

This application is a non-provisional under 35 USC 119(d) of, and claims the benefit of U.S. Provisional Application 62/017,685 filed on Jun. 26, 2014, the entire disclosure of which is incorporated herein by reference.

BACKGROUND

1. Technical Field

This invention is related to armor, and in particular for helmets or other body protection against blasts and/or small arms fire.

2. Related Technology

Effective armor technologies have been sought for many decades to protect humans, vehicles, and systems against projectile weapons and explosive blasts.

Recent developments by the U.S. Navy in laminate armor are disclosed in U.S. Pat. No. 7,300,893 to Barsoum et al., U.S. Pat. No. 8,746,122 to Roland et al., and U.S. Pat. No. 8,789,454 to Roland et al., each of which is incorporated herein by reference.

U.S. Patent Publication No. 2012/0312150 to Gamache et al., is also incorporated by reference in its entirety. U.S. Pat. No. 6,112,635 to Cohen et al., U.S. Pat. No. 4,179,979 to Cook et al., U.S. Pat. No. 6,912,944 to Lucata et al., U.S. Pat. No. 7,874,239 to Howland et al. describe additional armor-related technologies. Porter, J. R., Dinan, R. J., Hammons, M. I., and Knox, K. J., "Polymer coatings increase blast resistance of existing and temporary structures", AMPTI AC Quarterly, Vol. 6, No. 4, pp. 47-52, 2002, describes work at the Air Force Research Laboratory, describes an approach for reducing fragmentation (flying debris) of the structure destroyed by a blast. Tekalur, S. A, Shukla, A., and Shivakumar, K., "Blast resistance of polyurea based layered composite materials", Composite Structures, Vol. 84, No. 3, pp. 271-81, (2008) discloses test results for layered and sandwiched layers of polyurea and E-glass vinyl ester.

Reference is also made to A. Tasdemirci, I. W. Hall, B. A. Gama and M. Guiden, "Stress wave propagation effects in two- and three-layered composite material", Journal of Composite Materials, Vol. 38, pp. 995-1009, (2004). Possible mechanisms contributing to the blast and ballistic mitigation of composites are discussed in Xue, Z. and Hutchinson, J. W., "Neck development in metal/elastomer bilayers under dynamic stretchings", International Journal of Solids and Structures, Vol. 45, No. 3, pp. 3769-78, (2008); in Xue, Z. and Hutchinson, J. W., "Neck retardation and enhanced energy absorption in metal-elastomer bilayers", Mechanics of Materials, Vol. 39, pp. 473-487, (2007); and in Malvar, L. J., Crawford, J. E., and Morrill, K. B.; "Use of composites to resist blast", Journal of Composites for Construction, Vol. 11, No. 6, pp. 601-610, (November/December 2007). Information on the material properties of viscoelastic materials is found in D. I. G. Jones, Handbook of Viscoelastic Vibration Damping, Wiley, 2001, pp. 39-74. A review of mechanical behavior of viscoelastic materials can also be found in R. N. Capps, "Young's moduli of polyurethanes", J. Acoustic Society of America, V. 73, No. 6, pp. 2000-2005, June 1983.

BRIEF SUMMARY

An armor system having a substrate, a layer of elastomeric polymer positioned on the front surface of the substrate, with hollow ceramic or metal spheres being encapsulated within the elastomeric polymer layer, the elastomeric polymer having a glass transition between zero degrees Celsius and negative 50 degrees Celsius.

Another aspect is an armor without an underlying substrate and having a layer of elastomeric polymer positioned on the front surface of the substrate, with hollow ceramic or metal spheres being encapsulated within the elastomeric polymer layer, the elastomeric polymer having a glass transition between zero degrees Celsius and negative 50 degrees Celsius.

A method of forming an armor system includes providing a substrate, adding a plurality of hollow ceramic or metal spheres at one surface of the armor substrate such that the spheres form least one layer in a direction normal to the surface of the substrate, filling the interstitial spaces between the hollow ceramic spheres with an uncured elastomeric polymer; and allowing the elastomeric polymer to cure.

An armor system can be formed by encapsulating a plurality of hollow ceramic or metal spheres within a layer of elastomeric polymer; and positioning the layer of elastomeric polymer at one surface of the armor substrate such that the spheres form least one layer in a direction parallel to the surface of the substrate. For higher molecular weight polymers, encapsulating the plurality of ceramic spheres involves pressing a higher molecular weight elastomeric polymer around the hollow ceramic spheres.

DETAILED DESCRIPTION

The armor systems described below are intended to improve the blast resistance of lightweight armor that currently protects against rounded tip or ball type small arms and fragmentation. In particular, the armor systems described herein are suitable for helmets or other body-armor, or blast panels for various applications.

In the systems described below, a large number of hollow spheres of a hard material are encapsulated in a layer of elastomeric material having a glass transition temperature within a particular range described below. Rigidity is imparted to the system by either an underlying rigid substrate, or by the rigidity of the elastomer itself at its operational temperature.

FIG. 1A-1C and FIG. 2A-2C illustrate armor systems that that includes a substrate and a coating layer on the front surface of the substrate. In each example, the coating layer is formed of hollow spheres encapsulated in an elastomeric polymer.

Figure 1A:
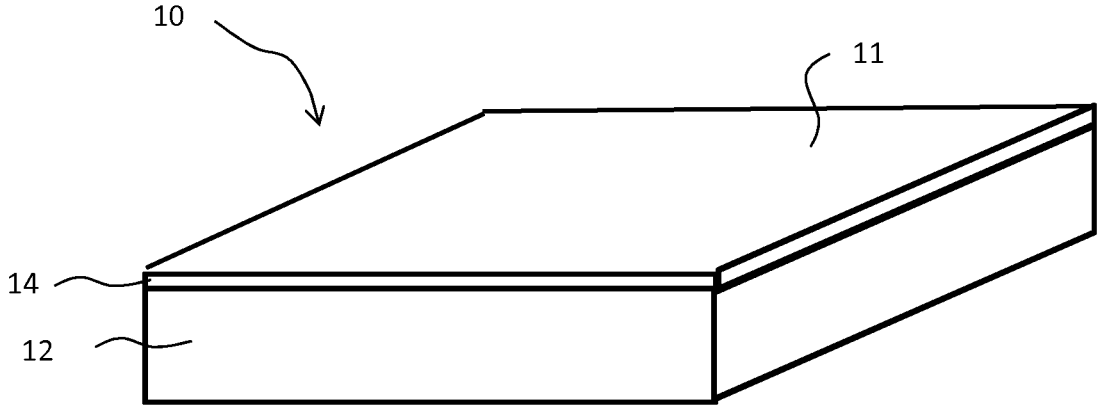
FIG. 1A illustrates an armor having a substrate and a coating layer with hollow ceramic or metal spheres encapsulated in an elastomeric polymer.
Figure 1B:
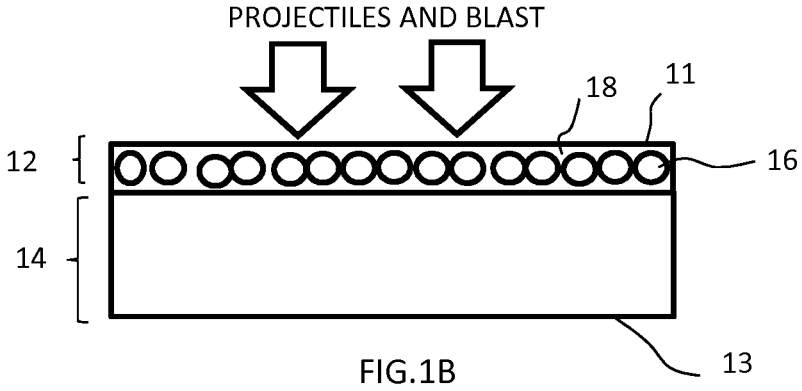
FIG. 1B illustrates a cross sectional view of the coating layer and substrate shown in FIG. 1A.
Figure 1C:
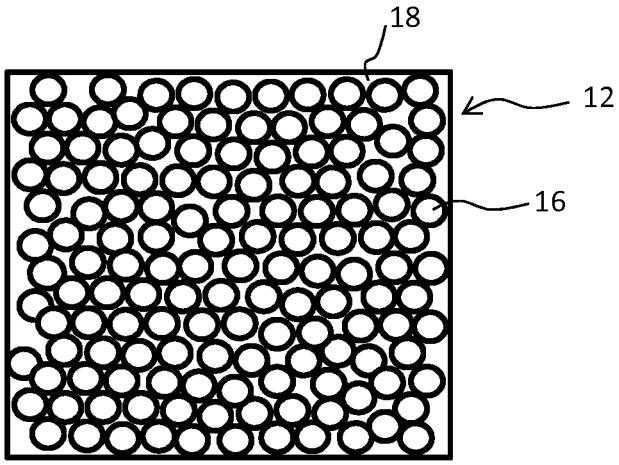
FIG. 1C is a cross sectional view taken through the coating layer in a plane parallel to the substrate.

In FIGS. 1A and 1B, the coating layer 14 on the front surface of the substrate 12 is formed of hollow ceramic spheres 16 encapsulated in an elastomeric polymer 18. In this example, a single layer (a "monolayer") of hollow ceramic spheres is encapsulated in the elastomeric polymer.

The front surface 11 of the ceramic-polymer coating layer faces toward the threat, and the rear surface of the substrate faces toward the person or object to be protected. Other layers may be positioned in front of the front surface 11, e.g. camouflage paint, fabric cover, or another cosmetic coating or cover. Other layers can be positioned behind the back surface 13 of the substrate 12, e.g., a cushioning pad or layer, a spall liner, or a helmet harness.

The elastomeric polymeric material is preferably a material with a glass transition temperature between about −50 degrees Celsius and 0 degrees Celsius. The elastomeric polymeric material that encapsulates the hollow ceramic spheres and coats the front surface of the hard substrate is believed to undergo an impact-induced phase transition when struck with a high velocity projectile (e.g., small arms or fragmentation), yielding large energy absorption, spreading the impact force to reduce the local pressure, and minimizing penetration of ballistic projectiles.

Some discussion of the theory of the phase transition for elastomeric coatings adjacent to hard armor layers is found in Roland, C. M., Fragiadakis, D., and Gamache, R. M., "Elastomer-steel laminate armor", Composite Structures, Vol. 92, pp. 1059-1064, 2010, in Bogoslovov, R. B., Roland, C. M., and Gamache, R. M., "Impact-induced glass transition in elastomeric coatings", Applied Physics Letters, Vol. 90, pp. 221910-1-221910-3, 2007, and in U.S. Pat. No. 8,789,454 to Roland et al., each of which is incorporated by reference herein in its entirety. When the glass transition temperature is less than, but sufficiently close to, the operational temperature, the impact of the projectile induces a transition to the viscoelastic glassy state. The transition to the viscoelastic glassy state is accompanied by large energy absorption and brittle fracture of the elastomeric polymer, which significantly reduces the kinetic energy of the projectile.

Suitable elastomeric polymers with glass transition temperatures between −50 degrees Celsius and 0 degrees Celsius include some polyureas, atactic polypropylene, polynorbornene, butyl rubber, polyisobutylene (PIB), nitrile rubber (NBR), and 1,2-polybutadiene. One suitable elastomeric polymer is a two-part elastomeric polyurea synthesized by mixing a multifunctional isocyanate with a polyamine. As one example, the isocyanate can be Dow Isonate 143L (produced by the Dow Chemical Company, headquartered in Midland, Tex.) and the polyamine can be one of the Air Products Versalink polyamines, such as P-1000, P-2000, and P-650. This two-part polymer, after mixing and before it cures, flows readily into the interstitial spaces between and around the spheres. This allows the polyurea-ceramic coating layer to be formed by pouring the uncured polyurea mixture over a layer of hollow ceramic spheres, and allowing the polyurea to cure. The polyurea layers can also be spray applied or applied with a brush or other applicator. The polyurea can also be applied as a foam. Some of the higher molecular weight polymers mentioned above can provide good blast and penetration resistance, however, because they do not flow as readily, additional equipment (e.g., a hydraulic press) is required to encapsulate the spheres within the polymer layer by forcing the less viscous polymer to flow around the spheres.

It is believed that three mechanisms may contribute to blast resistance of the armor. A first mechanism is the energy dissipation due to viscoelasticity of the elastomer. In particular, the viscoelastic polymer absorbs energy when struck with high velocity impact or pressure waves, such as explosives-based acoustic waves. If the viscoelastomer undergoes a phase transition from rubbery to glassy, it absorbs even more energy than if the viscoelastomer does not undergo the phase transition. However, viscoelastomers that do not undergo a phase transition are also suitable.

Second, blast resistance performance appears to be enhanced by the energy dissipation that results from the breakup of the hollow spheres.

Third, the acoustic impedance mismatches between the hollow spheres and the elastomer and between the substrate and the elastomer present the incoming wave with repeated impedance mismatches. The consequent reflections successively attenuate the wave amplitude by virtue of destructive interference of wave interaction as well as extended path length through the energy dissipative elastomer and spatial and temporal dispersion of the wave. This appears to improve blast mitigation by deviation of the pressure wave, reducing instantaneous peak amplitudes of the pressure wave, and increasing transit times through the dissipative polymer coating.

Figure 2A:
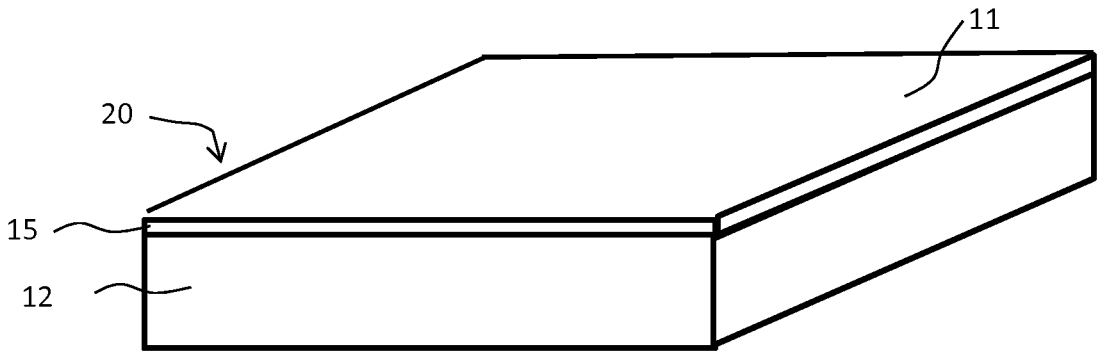
FIG. 2A illustrates an armor having a substrate and a coating layer with hollow ceramic or metal spheres encapsulated in an elastomeric polymer.
Figure 2B:
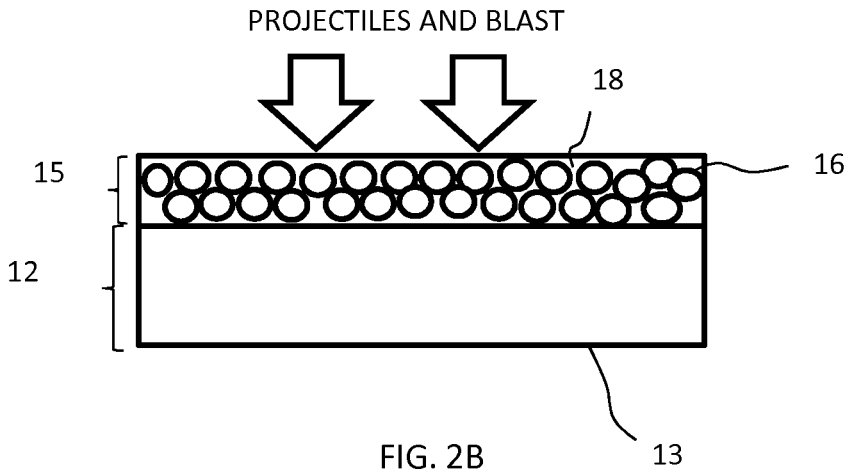
FIG. 2B illustrates a cross sectional view of the coating layer and substrate shown in FIG. 2A.
Figure 2C:
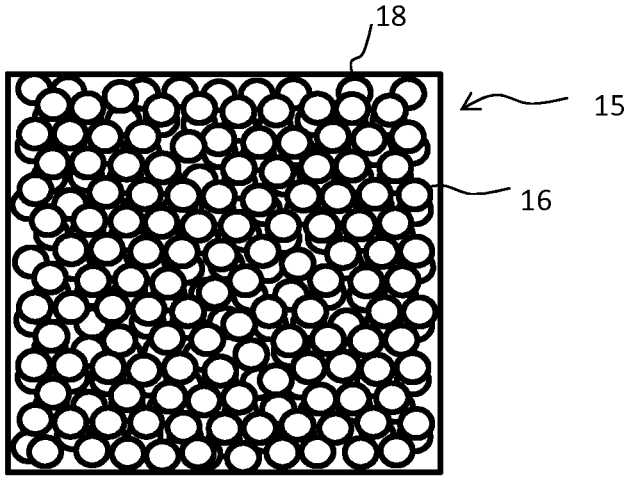
FIG. 2C illustrates a cross sectional view of the coating layer in a plane parallel to the substrate.

FIGS. 2A, 2B, and 2C show an armor system 20 with a substrate 14 and an elastomeric polymer coating layer 15 having more than one layer of hollow ceramic or metal spheres 16 encapsulated in the elastomeric polymer 18. Although two layers of hollow spheres are shown, it can also be suitable to include more than two layers, or to form the layers of a blend of different diameter hollow spheres. The thickness of the coating layer will increase with increasing layers of hollow spheres, so an appropriate number of layers, size of spheres, and thickness of the coating layer can be selected based on engineering analysis of the requirements for blast and ballistic protection and the armor weight restrictions.

Figure 3:
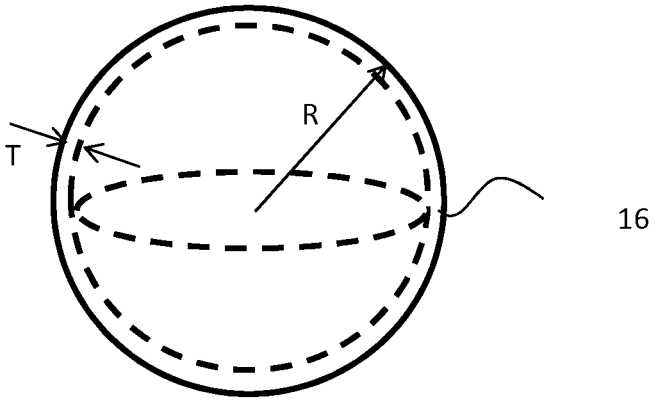
FIG. 3 shows hollow ceramic or metal sphere suitable for use in the armor shown in FIG. 1A-1C, FIG. 2A-2C, or FIG. 4A-4C.

The hollow spheres 16, shown in FIG. 3, can be a ceramic such as silicon carbide, boron carbide, and alumina ($Al_2O_3$), and can have outer diameters in about the one millimeter (mm) to 5 mm range. In some applications, the outer diameter can be more that 5 mm. The hollow spheres can be a blend of diameters within a range, for example, between one mm and 5 mm, and in some applications, can have diameters greater than 5 mm. Small spheres keep the coating layer relatively thin, to minimize overall armor thickness and weight.

To keep the overall weight of the armor system low, the wall thickness of the hollow ceramic spheres is selected to provide a mass density approximately equal to that of the elastomeric polymer in which spheres are embedded. This allows the concentration of spheres to not affect the areal density of the armor (i.e., the mass per unit area, which is a standard metric for armor weight). As one example, the mass density of an elastomeric polymer with either the one mm diameter or the three diameter hollow ceramic spheres is 1.0±0.2 g/cc. Spheres typically can be ordered from a manufacturer by specifying diameter and density. The thickness of the spheres can also be designed to optimize performance against a given threat level; that is, the irreversible fracture of the spheres and associated energy dissipation is governed by their wall thickness and the blast intensity.

Suitable silicon carbide hollow spheres are commercially available. It is noted that some commercially available hollow spheres have a small hole through the wall as a result of the manufacturing process. These spheres also seem to provide good blast resistance when encapsulated in the polymers as described herein. They also provide the option of filling the void space in the spheres with the polymer, as a means of controlling fracture and wave propagation behaviors.

The hollow spheres in each of the examples herein can alternatively be formed of metal. Suitable materials include steel and aluminum. Because hollow metal spheres are heavier than equally sized hollow ceramic spheres, they may more appropriate for applications in which weight is not critical. Other materials having sufficient strength and rigidity and with a different acoustic impedance than the elastomer coating may also be suitable.

Figure 4A:
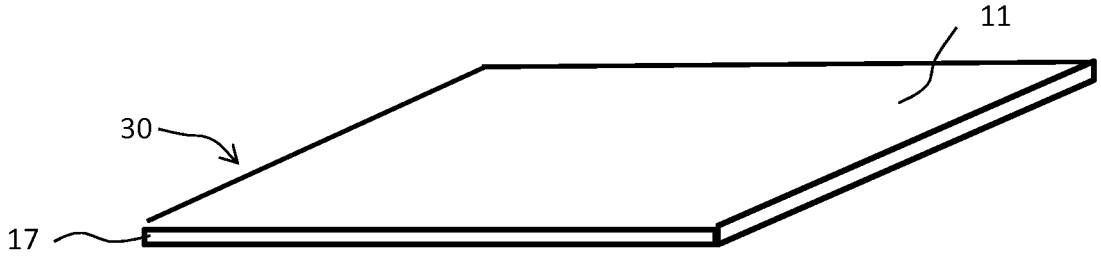
FIG. 4A-4C show a layer of an armor with hollow ceramic or metal spheres encapsulated in an elastomeric polymer without an underlying substrate.
Figure 4B:
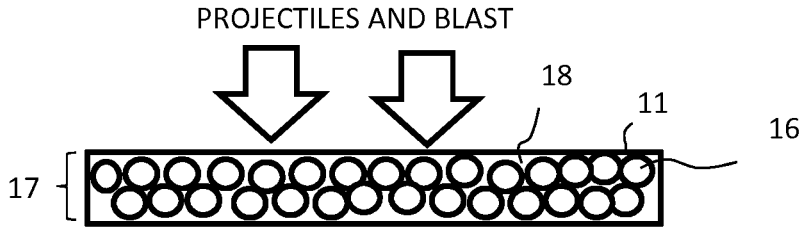
Figure 4C:
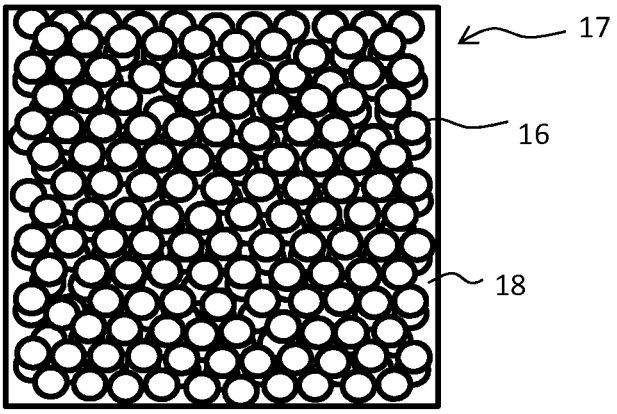

FIG. 4A-4C show a layer of an armor 30 having a coating layer 17 (without a substrate) formed of hollow ceramic or metal spheres 16 encapsulated in the elastomeric polymer 18. This layer 17 can be a component of an armor system, or can be a stand-alone armor protection system. For example, to improve the blast protection of a structure, the armor 30 coating layer with encapsulated hollow ceramic or metal spheres can be added to the front surface of the structure.

In one example, the armor system can be formed by pouring a small amount of uncured two-part polyurea elastomer onto the surface of the substrate. The hollow spheres are placed on the layer on elastomer, and more uncured elastomer is poured onto the spheres and allowed to flow around the spheres. Enough polyurea is poured over the spheres to form smooth polyurea surface.

Initially pouring a small amount of the elastomer onto the substrate is believed to improve the adhesion of the elastomer to the substrate. However, it may also be suitable to place the hollow spheres directly on the substrate, and subsequently adding all the elastomer.

For higher molecular weight polymers, a hydraulic press can be used to form the polymer around the spheres.

One suitable application for this armor is in personnel helmets intended for protection against small arms fire, fragmentation, and blasts. The Advanced Combat Helmet used by some United States military forces includes a layer of a composite material formed of unidirectional ballistic fiber and a resin as the primary ballistic protection. The ballistic fiber can be a para-aramid synthetic fiber such as KEVLAR® fiber, commercially available from DuPont, headquartered in Wilmington, Del. Alternatively, the fibers can be composed of ultra-high molecular weight polyethylene (UHMWPE), such as that sold under the tradename Dyneema® by DSM, headquartered in Heerlen, Netherlands. The resin can be a rubber toughened phenolic thermoset resin, or a variation of the elastomer used to encapsulate the spheres can be used as the resin, e.g., polyurea. Additional information related to the ACH resin can be found at S. M. Walsh, et al., "Hybridized Thermoplastic Aramids: Enabling Material Technology for Future Force Headgear", US ARMY Research Laboratory Weapons and Materials Research Directorate Aberdeen Proving Ground, Report dated 1 Nov. 2016, sections 2.1-2.3, incorporated herein by reference.

For helmet applications, the substrate can be about ¼ inch thick or more.

With improvement in the performance of helmets as a goal, 12 inch square test panels were constructed to match the design of the Advanced Combat Helmet (ACH), but with a polyurea-embedded layer of hollow ceramic spheres replacing a substantial portion of the standard KEVLAR-resin layer in an ACH panel. The hollow SiC spheres were embedded in elastomeric polyurea formed by mixing Dow Isonate 143L+Air Products Versalink. Tests were accomplished for panels with coatings having 1 mm spheres and for panels with coatings having 3 mm spheres, each of which were 10% lighter than the standard ACH panel.

Ballistics tests were conducted in accordance with MIL-STD-662F V50 for a test panel with a KEVLAR/resin substrate and a polymer-ceramic coating comprised of the two-part polyurea coating and 1 mm diameter hollow SiC spheres that are 33% of the coating by weight. A control panel was built to ACH standards with KEVLAR fiber/resin material. The thickness of the KEVLAR substrate for the test panel was such that the test panel was 10% lighter than the control panel. For the test panel with the polymer-ceramic coating, the V-50 penetration velocity for 16 gram right circular cylinder (RCC) bullets was measured to be 2727 feet per second (ft/s). The V-50 was 2717 ft/s for 16 gr RCC bullets against the ACH control specimen. Thus, replacing a portion of the ACH KEVLAR layer with a polymer layer embedded with hollow ceramic spheres can provide comparable ballistic protection against blunt tip small arms fire at a lighter weight.

Blast tests were conducted on several different specimens of armor having a substrate and a coating with hollow ceramic spheres encapsulated within a polymer having a glass transition temperature between −50 C and 0 C.

Figure 5:
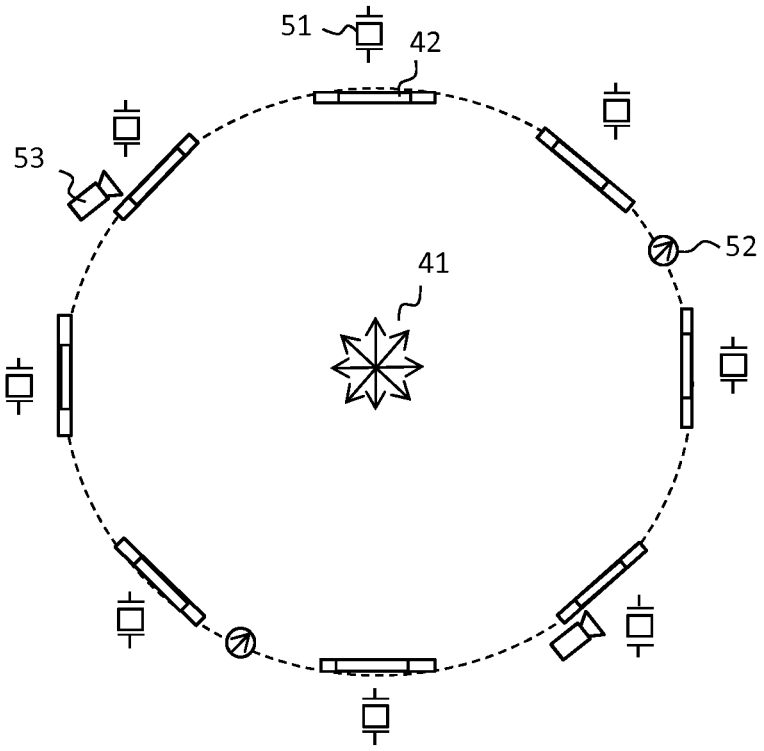
FIG. 5 illustrates a blast test configuration for blast-testing the armor.

FIG. 5 illustrates the blast-test set-up. Each panel was supported on all four sides along its entire perimeter, to minimize any wrap-around effect of the blast wave. A ⅛ pound of Pentolite 41 was ignited at the center of the blast diameter, with several panels 42 positioned facing the center.

An accelerometer 51 positioned at the center behind the rear face of each panel measured the displacement, velocity, and displacement of the panel's rear surface. Pressure gauges 52 were positioned at the same distance from the explosive as the panels. High speed video cameras 53 were positioned behind several of the panels to capture the displacement of the panels. The following ceramic spheres were used in the blast tests: (a) 1 mm hollow SiC spheres manufactured by Deep Springs Technology (DST), with bulk densities of: 0.53 g/cc, 0.55 g/cc, 0.6 g/cc, and 0.7 g/cc; (b) 3 mm hollow SiC spheres from Deep Springs Technology, with bulk densities of 0.50 g/cc and 0.51 g/cc; (c) mixture of sizes in the range of 1-2 mm alumina hollow spheres from Stikloporas; (d) mixture of sizes in the range of 2-4 mm alumina hollow spheres from Stikloporas.

The following panels were blast tested.

(a) a KEVLAR substrate with a polyurea coating with encapsulated 1 mm hollow SiC spheres with bulk density 0.53 g/cc from DST (the spheres are 33% by weight of the coating).

(b) a KEVLAR substrate with a polyurea coating with encapsulated 1 mm hollow SiC spheres with bulk density 0.73 g/cc from DST (the spheres are 33% by weight of the coating).

(c) a KEVLAR substrate with a polyurea coating with an encapsulated monolayer of 1 mm hollow SiC spheres with bulk density 0.53 g/cc from DST.

(d) a KEVLAR substrate with a polyurea coating with an encapsulated monolayer of 1 mm hollow SiC spheres with bulk density 0.60 g/cc from DST (33% by weight of the coating).

(e) a KEVLAR substrate with a polyurea coating with encapsulated 1 mm hollow SiC spheres with bulk density 0.60 g/cc from DST (33% by weight of the coating).

(f) a KEVLAR substrate with a polyurea coating with an encapsulated monolayer of 1 mm hollow SiC spheres with bulk density 0.60 g/cc from DST.

(g) a KEVLAR substrate with a polyurea (PU-2000) coating with encapsulated 1 mm hollow SiC spheres with bulk density 0.73 g/cc from DST (33% by weight of the coating).

(h) a KEVLAR substrate with a polyurea (PU-650 foam) coating with encapsulated 1 mm hollow SiC spheres with bulk density 0.73 g/cc from DST (33% by weight of the coating).

(i) a KEVLAR substrate with a polyurea coating with an encapsulated monolayer of 3 mm hollow SiC spheres with bulk density 0.51 g/cc from DST.

(j) a KEVLAR substrate with a polyurea coating with encapsulated 3 mm hollow SiC spheres with bulk density 0.51 g/cc from DST (33% by weight of the coating).

(k) a KEVLAR substrate with a polyurea coating with encapsulated 3 mm hollow SiC spheres with bulk density 0.51 g/cc from DST (33% by weight of the coating).

(l) a KEVLAR substrate with a polyurea (PU-1000 foam) coating with encapsulated aluminum oxide (alumina, $Al_2O_3$) hollow spheres with diameters varying from 1 mm to 2 mm (33% by weight of the coating).

(m) a KEVLAR substrate with a polyurea (PU-1000 foam) coating with an encapsulated monolayer of aluminum oxide (alumina, $Al_2O_3$) hollow spheres with diameters varying from 1 mm to 2 mm.

(n) a KEVLAR substrate with a polyurea coating with an encapsulated monolayer of aluminum oxide (alumina, $Al_2O_3$) hollow spheres with diameters varying from 1 mm to 2 mm.

(o) a KEVLAR substrate with a polyurea coating with an encapsulated monolayer of aluminum oxide (alumina, $Al_2O_3$) hollow spheres with diameters varying from 2 mm to 4 mm.

(p) a KEVLAR substrate with a butyl rubber coating.

(q) a control panel of 43 plies of KEVLAR.

Other panels of composite laminates, without hollow ceramic spheres, substrate were also tested.

Panels with hollow ceramic spheres embedded in polyurea showed the best results. The rear surfaces of these panels had 35% lower acceleration and 5% lower velocity than the rear surface of the ACH panel.

Although only one of the panels with hollow ceramic spheres embedded in polyurea was tested for ballistics penetration (the polyurea coating with 1 mm diameter hollow SiC spheres that are 33% of the coating by weight and a KEVLAR substrate), its penetration resistance at least matched the ballistic performance of the ACH.

Thus, the armor systems described herein are believed to reduce the weight of military helmets while improving blast mitigation properties and providing at least equivalent ballistic protection compared to current helmet technology. Helmets incorporating the ceramic-embedded polymer layer described herein has the potential to reduce traumatic brain injury for military-service members. The armor can be incorporated into head protection for other activities, such as athletic or sports competitions including bicycling, motorcycling, football and other high impact contact sports, and automobile racing. Hard hats for commercial and industrial applications can also incorporate the armor described herein. Other types of non-helmet armor protective systems can also incorporate the armor described herein.

The invention has been described with reference to certain preferred embodiments. It will be understood, however, that the invention is not limited to the preferred embodiments discussed above, and that modification and variations are possible within the scope of the appended claims.

What is claimed as new and desired to be protected by Letters Patent of the United States is:

1. An armor system, comprising:

a substrate;

an elastomeric polymer positioned on a surface of the substrate; and a plurality of hollow spheres encapsulated within the elastomeric polymer, wherein the elastomeric polymer has a glass transition temperature between zero degrees Celsius and negative 50 degrees Celsius, and wherein the plurality of hollow spheres are constructed to breakup when the elastomeric polymer in which the hollow spheres are encapsulated undergoes a phase transition from a rubbery state to a glassy state.

2. The armor system according to claim 1, wherein the substrate comprises unidirectional para-aramid synthetic fibers.

3. The armor system according to claim 1, wherein the substrate comprises polyethylene fibers.

4. The armor system according to claim 1, wherein the hollow spheres are hollow ceramic spheres.

5. The armor system according to claim 1, wherein the hollow spheres are hollow metal spheres.

6. The armor system according to claim 1, wherein the substrate further comprises a rubber toughened phenolic thermoset resin.

7. The armor system according to claim 1, wherein the substrate further comprises a polyurea resin.

8. The armor system according to claim 1, wherein the elastomeric polymer is an elastomeric polyurea.

9. The armor system according to claim 1, wherein the elastomeric polymer is a foam.

10. The armor system according to claim 8, wherein the elastomeric polyurea is a synthesis of a multifunctional isocyanate and a polyamine.

11. The armor system according to claim 10, wherein the multifunctional isocyanate is methylene diphenyl diisocyanate and the polyamine is oligomeric diamine.

12. The armor system according to claim 1, wherein a mass density of the elastomeric polymer with the encapsulated hollow spheres is in a range of 0.8 grams per cubic centimeter and 1.2 grams per cubic centimeter.

13. The armor system according to claim 1, wherein a mass density of the elastomeric polymeric with the encapsulated hollow spheres is less than a mass density of a layer of para-aramid synthetic fiber in a rubber toughened phenolic thermoset resin in an Advanced Combat Helmet.

14. The armor system according to claim 1, wherein the encapsulated hollow spheres form a single layer extending substantially parallel to a surface of the substrate.

15. The armor system according to claim 1, wherein the encapsulated hollow spheres form a plurality of layers extending substantially parallel to a surface of the substrate.

16. The armor system according to claim 1, wherein the hollow spheres have an outer diameter equal to or less than 5 millimeters.

17. The armor system according to claim 1, wherein the hollow spheres are a mixture of spheres with outer diameters in a range of 1 to 2 mm.

18. The armor system according to claim 1, wherein the hollow spheres are a mixture of spheres with outer diameters in a range of 2 to 4 mm.

19. The armor system according to claim 1, wherein a thickness of a layer comprising the elastomer polymer and the plurality of hollow spheres encapsulated within the elastomeric polymer is less than 4 mm.

20. The armor system according to claim 4, wherein the hollow ceramic spheres comprise alumina, boron carbide, or silicon carbide.

21. The armor system according to claim 5, wherein the hollow metal spheres are aluminum or steel.

22. The armor system according to claim 1, wherein a mass density of the hollow spheres is approximately equal to a mass density of the elastomeric polymer.

* * * * *